US009433274B1

(12) United States Patent
Morrison

(10) Patent No.: US 9,433,274 B1
(45) Date of Patent: Sep. 6, 2016

(54) FINGER SCRUBBER

(71) Applicant: Jim A. Morrison, Hernando, FL (US)

(72) Inventor: Jim A. Morrison, Hernando, FL (US)

( * ) Notice: Subject to any disclaimer, the term of this patent is extended or adjusted under 35 U.S.C. 154(b) by 0 days.

(21) Appl. No.: 14/873,266

(22) Filed: Oct. 2, 2015

(51) Int. Cl.
*A46B 13/02* (2006.01)
*A45D 29/17* (2006.01)
*A46B 13/00* (2006.01)

(52) U.S. Cl.
CPC ..... *A45D 29/17* (2013.01); *A46B 13/001* (2013.01); *A46B 13/026* (2013.01); *A46B 2200/1013* (2013.01)

(58) Field of Classification Search
CPC ..... A46B 13/02; A46B 2200/1013; A46B 2200/3013; A46B 13/001; A46B 13/026; A47K 7/04; B08B 9/021; B08B 9/023; A45D 29/17
USPC ..... 15/21.1
See application file for complete search history.

(56) References Cited

U.S. PATENT DOCUMENTS 2,424,509 A 7/1947 Singer
2,629,124 A 2/1953 Merritt
4,180,884 A 1/1980 Hess et al.
4,255,826 A * 3/1981 Boyd ..... A46B 13/04 132/73.6
4,301,567 A * 11/1981 Tucker ..... A46B 7/04 15/104.04
4,381,574 A * 5/1983 Benkovsky ..... A63B 47/04 15/21.2
5,048,547 A 9/1991 Walker
5,640,979 A 6/1997 Trenary
5,823,203 A * 10/1998 Carroll ..... A45D 29/007 132/200
6,016,812 A 1/2000 Guynn
6,086,275 A 7/2000 King
6,116,248 A * 9/2000 Walker ..... A45D 29/007 132/74.5
6,314,965 B1 11/2001 Walker
6,813,798 B2 11/2004 Moga
6,901,935 B2 6/2005 Chang
6,983,508 B2 1/2006 Saurer
7,267,125 B2 9/2007 Nevakshonoff
7,789,090 B2 9/2010 Tran
7,918,233 B2 4/2011 Burgess et al.
7,993,309 B2 8/2011 Schweikert
8,474,408 B2 7/2013 Leary et al.
8,893,735 B2 11/2014 Shatz

* cited by examiner

*Primary Examiner* — Laura C Guidotti
(74) *Attorney, Agent, or Firm* — Hanrahan Law Firm, P.A.; Benjamin M. Hanrahan

(57) ABSTRACT

A finger scrubber including a brush sleeve and an electrically powered base or body is presented herein. The brush sleeve includes a generally cylindrical configuration cooperatively sized to accommodate a user's finger therein. One or more brush components suitable to scrub or clean a finger are disposed on the inside of the brush sleeve. Furthermore, the body, and in particular, a drive assembly is structure to cooperatively engage the brush sleeve and rotationally drive the brush sleeve via selective activation of a switch or activation assembly. Moreover, the drive assembly is configured to rotationally drive the brush sleeve in alternating rotational directions via successive activations.

15 Claims, 9 Drawing Sheets

FINGER SCRUBBER

FIELD OF THE INVENTION

The present invention is generally directed to a scrubbing or cleaning device, and in particular, to an electrically operated finger scrubber.

BACKGROUND OF THE INVENTION

Basic hygiene requires constant cleaning or washing of the hands and fingers, particularly for those individuals who work in industrial environments and are often exposed to dirty and greasy machinery, automobiles, and the like. While a variety of different cleaning products exist and have been around for many years, a problem often encountered is the difficulty of removing dirt, grease and grime in the areas of the fingernails, knuckles and cuticles. For instance, while a typical hand wash in a sink may eliminate some of the dirt, grease and grime on the larger surfaces of the hands, such as on the palm of the hand or on the back of the hand, it is often extremely difficult to remove dirt, grease and grime at or near the fingernails, under the fingernails, and near the cuticles and knuckles.

Accordingly, there is a need in the art for a device that can be used to aid in the removal of dirt, grease and grime, and other contaminants, on a user's fingers, and in particular, at or near the fingernail, knuckles and cuticle locations. The proposed device may include a tubular or cylindrical brush sleeve with a plurality of bristles or brushing components disposed on the interior thereof. The brush sleeve may be sized to accommodate the insertion of one or more fingers therein during operation while the bristles or brushing components contact or engage the surface of the finger(s). A bottom brush may also be included at the base or inside distal end of the brush sleeve for cleaning or engaging the tip of the finger or under the fingernail, for example. An electrically powered body or base may interconnect with the brush sleeve and rotationally move the brush sleeve around the user's finger during operation, thereby engaging the surfaces of the finger with the bristles as the brush sleeve moves.

SUMMARY OF THE INVENTION

The present invention is generally directed to a finger scrubber, and in some embodiments includes a brush sleeve and an electrically powered base or body. For instance, the brush sleeve of one embodiment may include a generally cylindrical or tubular configuration cooperatively sized to accommodate a user's finger therein. One or more brush components, for example, a plurality of bristles, scrubbing surfaces, or other surfaces or components suitable to scrub or clean a finger, are disposed on the inside of the brush sleeve. Specifically, the brush sleeve may include one or more lateral or side brushes that extend along the inner surface of the side wall of the brush sleeve and/or one or more bottom or distal brushes that is positioned at or near the base or inner distal end of the brush sleeve.

In some embodiments, the brush(es) may be removed from the brush sleeve for easy cleaning or replacement. For instance, there may be different brushes with different abrasive features or qualities such that one brush may include more rigid bristles that can generally be used as a deep abrasive scrub, while another brush can include softer bristles for use as a softer massaging scrub.

Furthermore, in certain embodiments, the body or base may cooperatively engage the brush sleeve and rotationally drive the brush sleeve via selective activation of a switch or activation assembly. For example, in one embodiment, the activation assembly may be activated via a slight pressure exerted by the brush sleeve, e.g., when a user places his or her finger in the brush sleeve and slightly presses inward toward the distal end. This will start a small AC motor or other drive assembly configured to rotate the brush sleeve about a longitudinal axis. Releasing the inward pressure may, in some embodiments, release the activation assembly and deactivate the motor.

It should also be noted that in some embodiments, the drive assembly may be configured to rotationally drive the brush sleeve in alternating directions (e.g., clockwise and counterclockwise directions). As an example, activating the drive assembly (e.g., via the slight inward pressure) may cause the drive assembly to rotationally drive the brush sleeve in one direction. Releasing the inward pressure will stop the rotation. Activating the drive assembly again, e.g., by again applying a slight inward pressure, will, in some embodiments, cause the drive assembly to rotationally drive the brush sleeve in an opposite direction.

During operation, the user may place an amount of desired soap, degreaser, or other solution (including, for example, hand lotion) into the brush sleeve to aid in the operation of the device, as desired.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
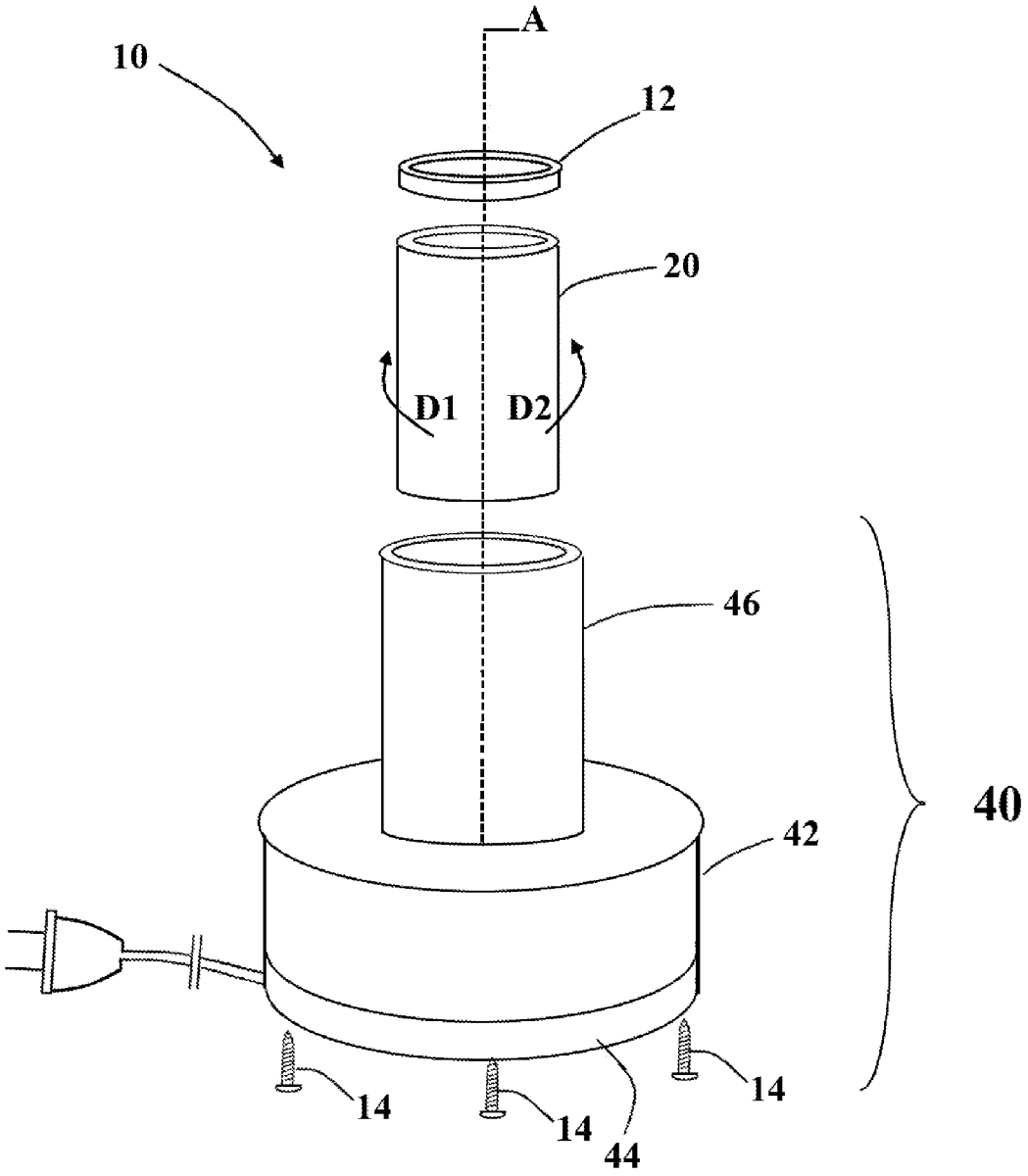
FIG. 1 is an exploded view of the finger scrubber as disclosed in accordance with at least one embodiment of the present invention.

As shown in the accompanying drawings, and with particular reference to FIG. 1, the present invention is directed to a scrubbing device, such as a finger scrubber, generally referenced as 10. Specifically, the device or scrubber 10 of the various embodiments provides a manner in which a user can easily clean or scrub his or her hands, and in particular, his or her fingers, including in areas at or near the fingernails, knuckles and cuticles which are often hard to clean without the use of the present invention.

Particularly, still referring to the exploded view represented in FIG. 1, at least one embodiment of the present invention includes a brush sleeve 20 and a body portion 40. For instance, the brush sleeve 20 of one embodiment will cooperatively engage with the body portion 40, and will rotate, for example about a longitudinal axis A. As will be described herein, the brush sleeve 20 includes one or more brush components 30 (e.g., bristles, scrubbers, or abrasive surface(s) suitable for scrubbing or cleaning a surface) disposed within an interior portion 25 thereof. Accordingly, a user may place his or her finger(s) within the interior portion 25 of the brush sleeve 20, and while the brush sleeve 20 rotates, for example about or around axis A, the brush components 30 will contact the user's finger(s) for purposes of scrubbing or cleaning. If desired, the user may place an amount of hand cleaner, soap, degreaser, or other solution, etc. within the brush sleeve 20 to aid or assist in the removal of dirt, grime and grease, for example, from the user's finger(s).

Specifically, in at least one embodiment, the brush sleeve 20 comprises an elongated cylindrical or tubular configuration with an at least partially open proximal end 21 and an oppositely disposed closed end 29 defining an interior portion 25 there between. Other configurations, shapes and sizes are contemplated within the full spirit and scope of the present invention. In any event, as briefly mentioned above, the brush sleeve 20 of at least one embodiment, includes one or more brush components 30 disposed with the interior portion 25 for eventual contact with a user's finger(s) or hand(s). It should be noted that the brush components 30 may include virtually any brush, bristles, scrubbers, sponges, abrasive surfaces or other surfaces or devices suitable to clean or scrub a user's finger(s), hand(s), etc. within the full spirit and scope of the present invention.

Figure 2:
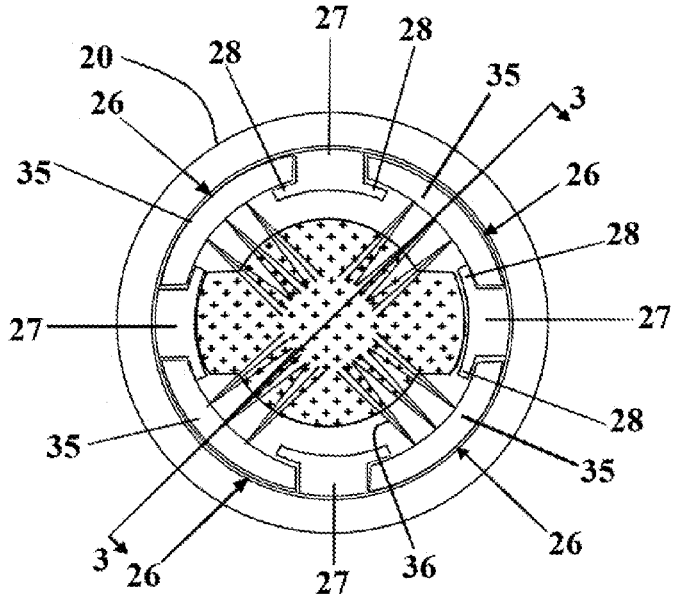
FIG. 2 is a top view of the brush sleeve as disclosed in accordance with at least one embodiment of the present invention.
Figure 3:
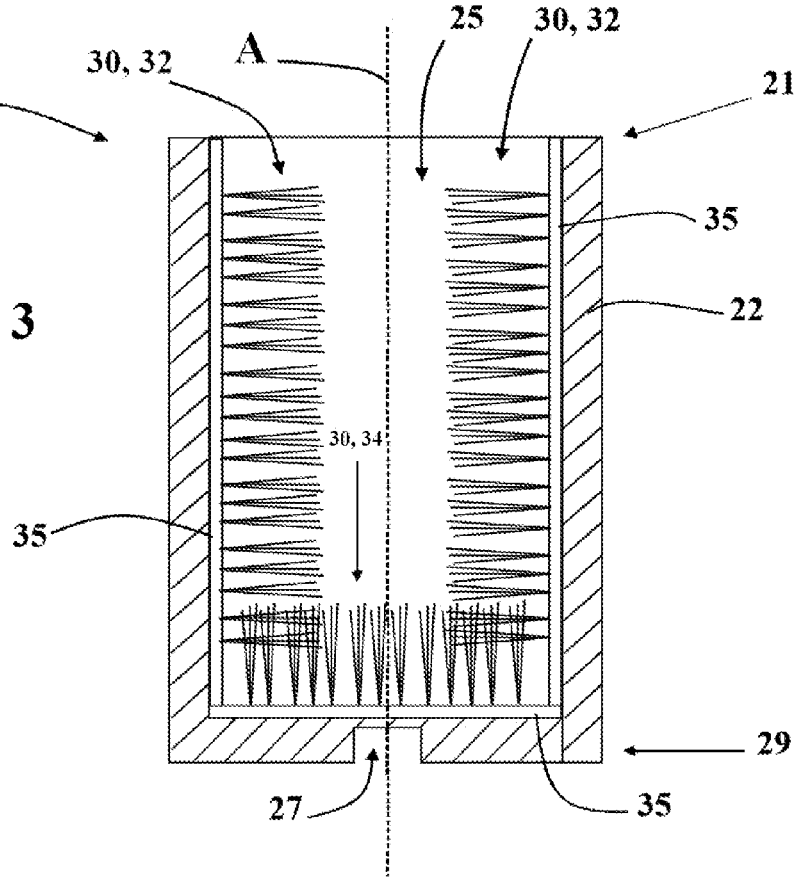
FIG. 3 is a sectional view along line 3-3 of the brush sleeve illustrated in FIG. 2.

Furthermore, with reference to an exemplary embodiment illustrated in FIGS. 2 and 3, the brush or scrubbing components 30 may include side or lateral brushes or bristles 32 disposed along an interior portion of the side wall(s) 22, for instance, between the proximal end 21 and the distal end 29 of the brush sleeve 20. These side or lateral brushes or bristles 32 may extend generally inward from the inner surface of the side wall(s) 22, as shown, for example, in the sectional view of FIG. 3.

Additionally, some embodiments may include one or more bottom brushes or bristles 34 that are disposed at or near the inner surface of the closed or distal end 29 of the brush sleeve 20. For example, as shown in FIG. 3, the base or bottom brush(es) or bristle(s) 34 may extend from the inner surface of the distal end 29 or distal wall 28 of the brush sleeve 20, as generally shown in FIG. 3. In this manner, as the user places his or her finger within the brush sleeve 20, for example, through the open or proximal end 21, the base or bottom brush(es) or bristle(s) 34 may function to clean or scrub the user's finger(s) at or near the fingertips and cuticles, while the lateral or side brush(es) or bristle(s) 32 may function to clean or scrub the sides of the user's finger.

In certain embodiments, the brush component(s) 30 may be removably disposed or removably attached to the brush sleeve 20, for example, in order to easily clean or replace the brush components 30, as desired. For example, in one embodiment, the brush sleeve 20 may include one or more retention channels 26, for instance, disposed on the inner surface of the one or more side walls 22. With reference to the exemplary embodiment shown in FIG. 2, retention channels 26 may be radially or otherwise disposed around the inner surface of side wall 22 and are defined by spaced apart protrusions 27 and/or ledges 28. Particularly, in at least one embodiment protrusions 27 extend outward from the inner surface of the side wall 22 and terminate with one or more ledges 28, as shown in FIG. 2. In this manner, adjacent protrusions 27 and/or the corresponding ledges 28 of at least one embodiment define a retention channel 26 disposed there between.

Accordingly, in certain embodiments, the brush component(s) 30 may include a base 35 which is cooperatively structured and configured to be disposed within the retention channel(s) 26, for example, in a sliding engagement. Particularly, the brush component(s) 30 of at least one embodiment may be slidingly disposed within the retention channel(s) 26 by inserting a base 35 of the brush component 30 into the retention channel 26, for example, at the open or proximal end 21 of the brush sleeve 20, and sliding the base 35 of the brush component 30 into the retention channel 26 such that the brush component 30 becomes cooperatively engaged to the interior wall of the brush sleeve 20, as shown in FIG. 2.

It should be noted that in some embodiments, the base 35 of the brush components 30 may be constructed of a partially flexible material, including, but not limited to a soft or flexible plastic, rubber, or resin material. This can allow the brush components 30 to easily conform to or mold to the shape of the cylindrical or tubular brush sleeve 20. Other embodiments may include a pre-formed and partially rigid brush component 30 that is cooperatively configured to slide or otherwise be disposed within the retention channel(s) 26. In any event, with the bush component(s) 30 in place within the brush sleeve 20, the bristles or other scrubbing surface of the brush component 30 will extend outward from the interior wall and into the interior portion 25 of the brush sleeve 20.

In certain embodiments, the retention channels 26 may extend substantially along the length of the brush sleeve 20, for example, substantially from the proximal open end 21 to the opposite distal end 29. This can allow the side or lateral brush(es) 32 to slidingly engage within the retention channel(s) 26 substantially along the length of the brush sleeve 20, as well as allowing the bottom brush 34 to slidingly engage with the same retention channel(s) 26.

For example, the bottom brush component 34 may also be removably disposed within the brush sleeve 20 in a similar manner, for example, by positioning cooperatively structured and configured base portions (not shown) of the bottom brush through one or more cooperative retention channels 26, and pushing or positioning the bottom brush component 34 to the inner surface of the distal end 29 of the brush sleeve 20. For example, the bottom brush 34 may include an outer peripheral edge (not shown) that include cooperative base portions or configurations such that the base portions will fit within all of the retention channels 26 on the inner surface of side wall 22. This can allow the entire bottom brush 34 to be pushed all the way down to the bottom of the brush sleeve 30.

It should be noted that other retention channels and cooperative engagements between the one or more brush components 30 of the various embodiments of the present invention are contemplated, and the retention channels 26 and base portion 35 shown in FIG. 2 should be considered exemplary in nature.

Turning back to the exploded view of FIG. 1, the scrubber 10 of at least one embodiment further includes a body 40 with which the brush sleeve 20 cooperatively engages or is otherwise connected. For instance, in one embodiment, the body 40 may include a base 42 and a sleeve housing 46 extending from the base 42. The sleeve housing 46 is cooperatively configured to receive the brush sleeve 20 therein, and in some embodiments, a retention cap 12 may be disposed over the open proximal end 21 of the brush sleeve 20 and connect to the sleeve housing 46. Particularly, in one embodiment, the brush sleeve 20 may be coaxially disposed within the sleeve housing 46 of the body 40, as generally illustrated in the exploded view of FIG. 1. The retention cap 12 may snap, screw or otherwise removably secure to a proximal end of the sleeve housing 46 in order to retain the brush sleeve 20 therein. As will be described herein, in certain embodiments, the brush sleeve 20 will be rotationally driven within the sleeve housing 46, for example, via an interconnected drive assembly 50. The retention cap 12 of certain embodiments may thus function to maintain the brush sleeve 20 and the brush components 30 within the sleeve housing 46 during operation of the present invention.

It should be noted that certain embodiments may not include a sleeve housing 46 such that the brush sleeve 20 may be interconnected, either removably or fixedly, to the base 42. In such an embodiment, the brush sleeve 20 will rotate about longitudinal axis A relative to the base 20, rather than within a cooperatively structured sleeve housing 46.

Figure 4:
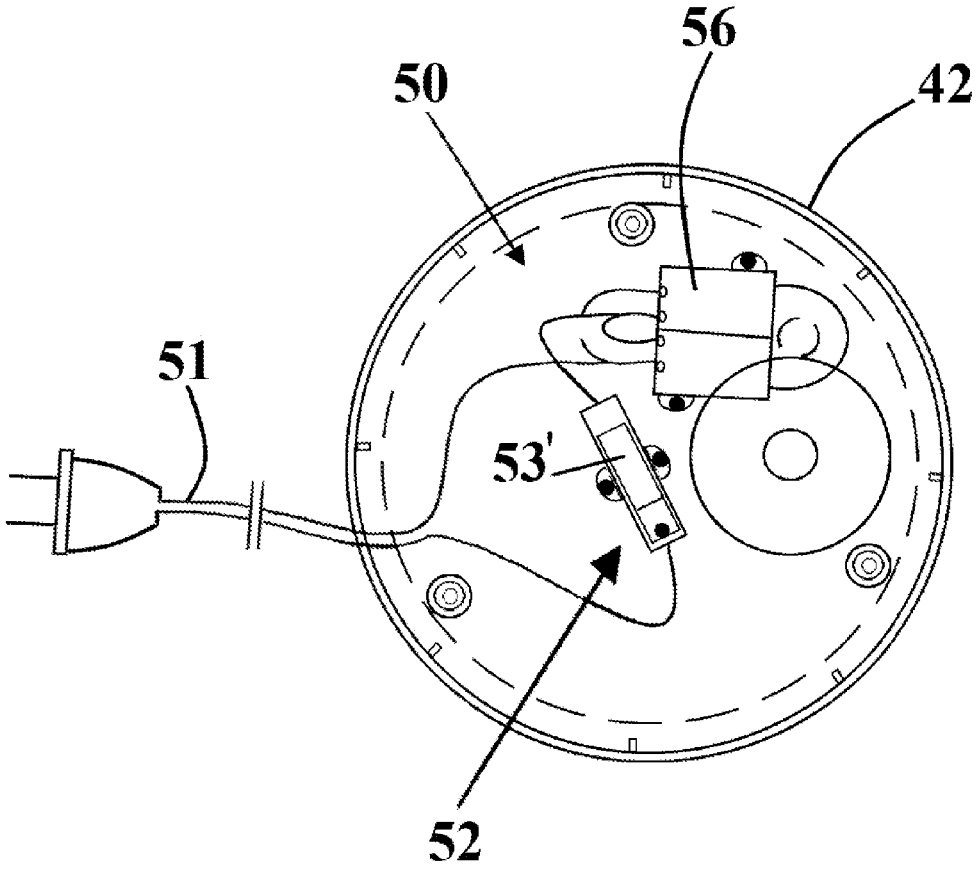
FIG. 4 is a top view of an exemplary drive assembly as disclosed in accordance with at least one embodiment of the present invention.

In any event, at least one embodiment of the present invention includes a drive assembly 50 structured and disposed to engage the brush sleeve 20 and at least temporarily drive the brush sleeve 20 in a rotational manner, for example, within the sleeve housing 46. For example, FIG. 4 shows a top down cut-away view of the base 42 or motor housing portion 44 thereof illustrating a schematic representation of a drive assembly 50 as disclosed in accordance with at least one embodiment. For instance, at least a portion of the drive assembly 50 may be housed or retained within a motor housing portion 46 of the base 42, which may be secured to base 42 via one or more screws or other attachment members 14.

Further, still referring to FIG. 4, at least one embodiment of the drive assembly 50 may include an electric or other motor 56 interconnected to an activation assembly 52 and a power source 51. The power source 51 may include a power cable or cord, as illustrated, which obtains electrical power or current from an outlet, for example. Other embodiments may include one or more batteries as the power source or as an additional power source.

Moreover, the motor 56 of certain embodiments may include virtually any motor cooperatively structured to rotationally drive the brush sleeve 20 of the various embodiments disclosed herein. In some implementations, the motor 56 may include a reversible motor structured to rotationally dispose in alternating or opposite rotational directions, as described in accordance with some embodiments of the present invention.

For example, when the motor 56 is selectively activated, as will be described herein, the drive assembly 50 at least one embodiment is structured to engage the brush sleeve 20 and rotationally dispose the brush sleeve 20 about or around a longitudinal axis A, for example, in a first direction indicated by directional arrow D1. In some embodiments, the next time the drive assembly 50 is activated, the drive assembly 50 will rotationally dispose the brush sleeve 20 about the longitudinal axis A in a direction opposite to the previous direction, for example, as indicated by directional arrow D2. Thus, as the drive assembly 50 is successively activated, as will be described herein, the drive assembly 50 of at least one embodiment is structured to dispose the brush sleeve 20 in successive alternating rotational directions.

For instance, in at least one embodiment, the activation assembly 52 is structured to selectively activate the drive assembly 50, and in particular, the motor 56 thereof, for selectively disposing the brush sleeve 20 in the rotational manner. Referring to the partial cut-away and schematic view of FIG. 5, the activation assembly 52 may be selectively activated upon exertion of a downward pressure or a force indicated by directional arrow D3. For example, in use, a user may place his or her finger within the brush sleeve 20, e.g., through the open proximal end 21, and lightly press or push the brush sleeve 20 in a direction parallel to the axis A or otherwise toward the activation assembly 52, as indicated by directional arrow D3. By doing so, the brush sleeve 20 of at least one embodiment will contact or engage the activation assembly 52 and activate the drive assembly 50 or motor 56 thereof. Thus, in at least one embodiment, there is not an external switch or on/off button that activates and/or deactivates the drive assembly 50. Rather, the internally disposed activation assembly 52 which is engaged or contacted by the brush sleeve 20 when pressure is exerted thereupon will serve to activate and deactivate the drive assembly 50.

Furthermore, in at least one embodiment, the drive assembly 50 is structured to continuously rotate or drive the brush sleeve 20 while a continuous pressure or force is exerted upon the activation assembly 52, for example, in direction of arrow D3. Thus, while a user pushes downward on the brush sleeve 20, or pushes on the brush sleeve 20 in the direction of the activation assembly 52, the drive assembly 50 will continuously drive or rotate the brush sleeve 20. Releasing the pressure or force in direction D3, will serve to release the activation assembly 52 and thereby deactivate the drive assembly 50. Thus, releasing the pressure or force upon the activation assembly 52 of at least one embodiment will stop the rotational movement of the brush sleeve 20.

Accordingly, use of at least one embodiment may include inserting a finger into the brush sleeve 20 and applying pressure upon the activation assembly 52, for example, by pushing the brush sleeve 20 along the axis A. While holding the pressure upon the activation assembly 52, the drive assembly 50 will drive the brush sleeve 20 in a rotational manner in one direction, for example, in direction D1. Releasing the pressure upon the activation assembly 52 will serve to deactivate the drive assembly 50 and stop the rotational movement of the brush sleeve 20. Applying pressure again to the activation assembly 52 of one embodiment will cause the drive assembly to drive the brush sleeve 20 in a rotational manner in an opposite direction, for example, in direction D2. The alternating directions D1, D2 of at least one embodiment will continue with each successive activations of the drive assembly 50.

It should be noted that in certain embodiments or implementations, rather than requiring a continuous force or pressure in direction D3 or upon the activation assembly 52 to maintain the rotational movement of the brush sleeve 20, as described immediately above, some embodiments may be configured such that a tap on the activation assembly 52 will cause the drive assembly to activate and/or deactivate. Some further embodiments may, upon activation of the drive assembly 50 (whether via a tap or constant pressure) automatically deactivate the drive assembly 50 after a certain predetermined amount of time.

Figure 5:
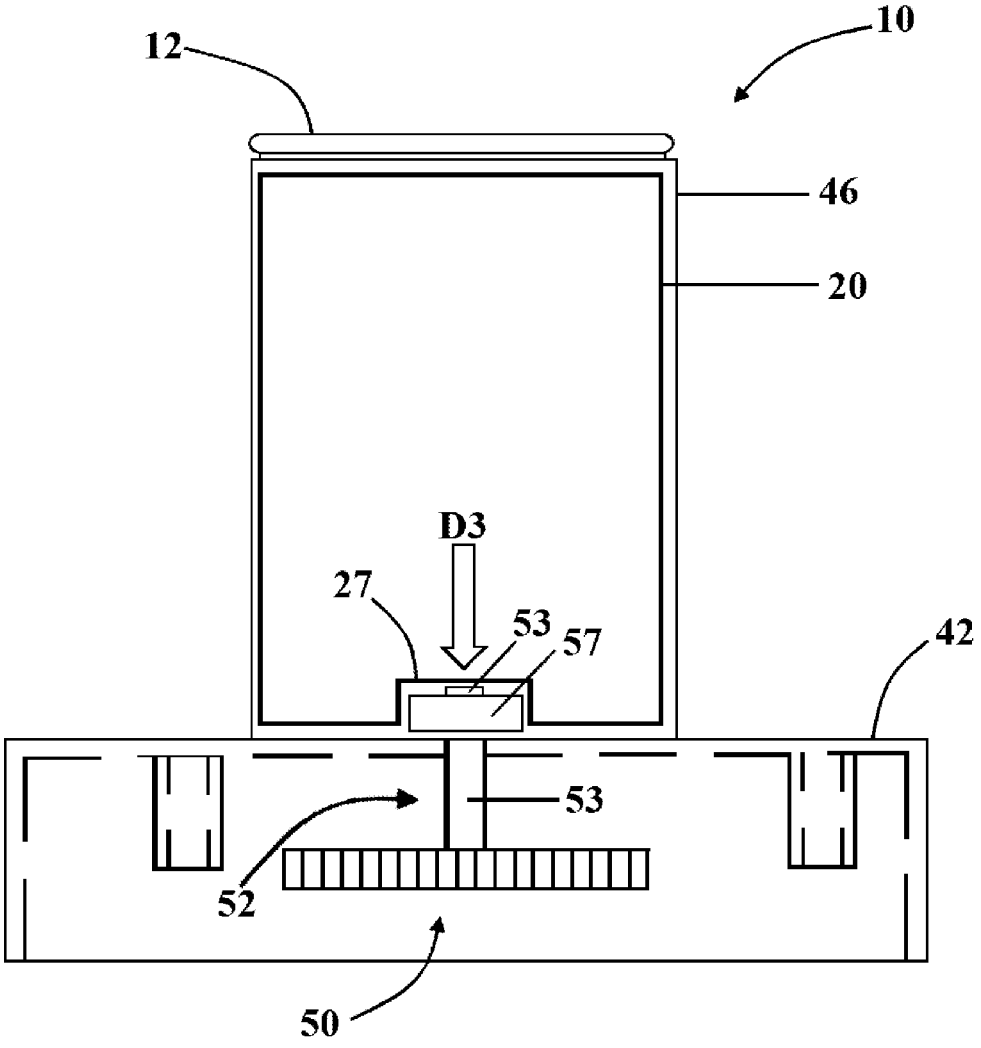
FIG. 5 is a partial sectional view of the finger scrubber as disclosed in accordance with at least one embodiment of the present invention.

Referring again to the exemplary embodiment of FIG. 5, the activation assembly 52 may extend at least partially within the sleeve housing 46 for a cooperative and selective engagement with the brush sleeve 20. For example, in one embodiment, the activation assembly 52 may include a plunger or activation rod 53 extending at least partially into the sleeve housing 46 and into the base 42 where the drive assembly 50 is housed. The plunger or activation rod 53 may be engaged or contacted by the distal end 29 of the brush sleeve 20, for example, when pressure is applied in direction D3. Upon contact or engagement between the plunger 53 and the distal end 29 of the brush sleeve 20, the plunger 53 will extend onto a contact switch 53' of the drive assembly 50, as shown in FIG. 4, for example. In at least one embodiment, while the plunger 53 engages or contacts the contact switch 53', the contact switch 53' will be activated, thereby activating the drive assembly 50.

Some embodiment may include a spring or other biasing mechanism attached to the plunger 53, for example, in order to normally dispose the plunder 53 in an non-activated state, or otherwise normally away from or disengaged from the contact switch 53'. Thus, when pressure is released from the plunger 53, the plunger 53 will automatically bias away from the contact switch 53' and automatically deactivate the drive assembly.

Other embodiments may include a plunger 53 or rod fixedly attached to the distal end 29 of the brush sleeve 20, such that pressure or force exerted in direction D3 will cause the plunger 53 to engage a contact switch 53' and activate the drive assembly 50 in a similar manner. Other plungers and activations assemblies are contemplated within the full spirit and scope of the present invention.

Additionally, still referring to FIG. 5, in certain embodiments, the brush sleeve 20 is rotationally driven, for example, within the sleeve housing 46, via a cooperative engagement between a portion of the drive assembly 50, such as a rotational drive mechanism 57, and a cooperatively structured drive engagement portion 27 of the brush sleeve 20. For instance, in at least one embodiment, the brush sleeve 20 includes a drive engagement portion 27 disposed at or near the distal end 29 thereof which is engaged by a cooperatively structured rotational drive mechanism 57 of the drive assembly 50.

For example, in the embodiment shown in FIG. 5, the rotational drive mechanism 57 includes a portion of the drive assembly 50 that extends into the sleeve housing 46 and engages the brush sleeve 20, and in particular, the drive engagement portion 27 thereof. In this embodiment, the drive engagement portion 27 of the brush sleeve 20 is a recessed portion on the distal end 20 of the brush sleeve 20 that cooperatively fits over and is engaged by the rotational drive mechanism 57 of the drive assembly 50. As an example, the rotational drive mechanism 57 may include a square, octagonal or other shaped nut or drive mechanism, and similarly, the drive engagement portion 27 may include a cooperatively configured square, octagonal or other shaped recess. Thus, when the drive assembly 50 is activated, the rotational drive mechanism 57 thereof is rotationally disposed, for example, within the sleeve housing 46. With the brush sleeve 20, and in particular, the recessed portion or drive engagement portion 27 thereof, cooperatively engaged with the rotational drive mechanism 57, the brush sleeve 20 will also rotate accordingly.

Other cooperative engagements between the brush sleeve 20 and the drive assembly 50 are contemplated within the full spirit and scope of the present invention, and thus, the rotational drive mechanism 57 and the cooperatively structured recessed portion or drive engagement portion 27 described herein should be consisted exemplary in nature.

Figure 6:
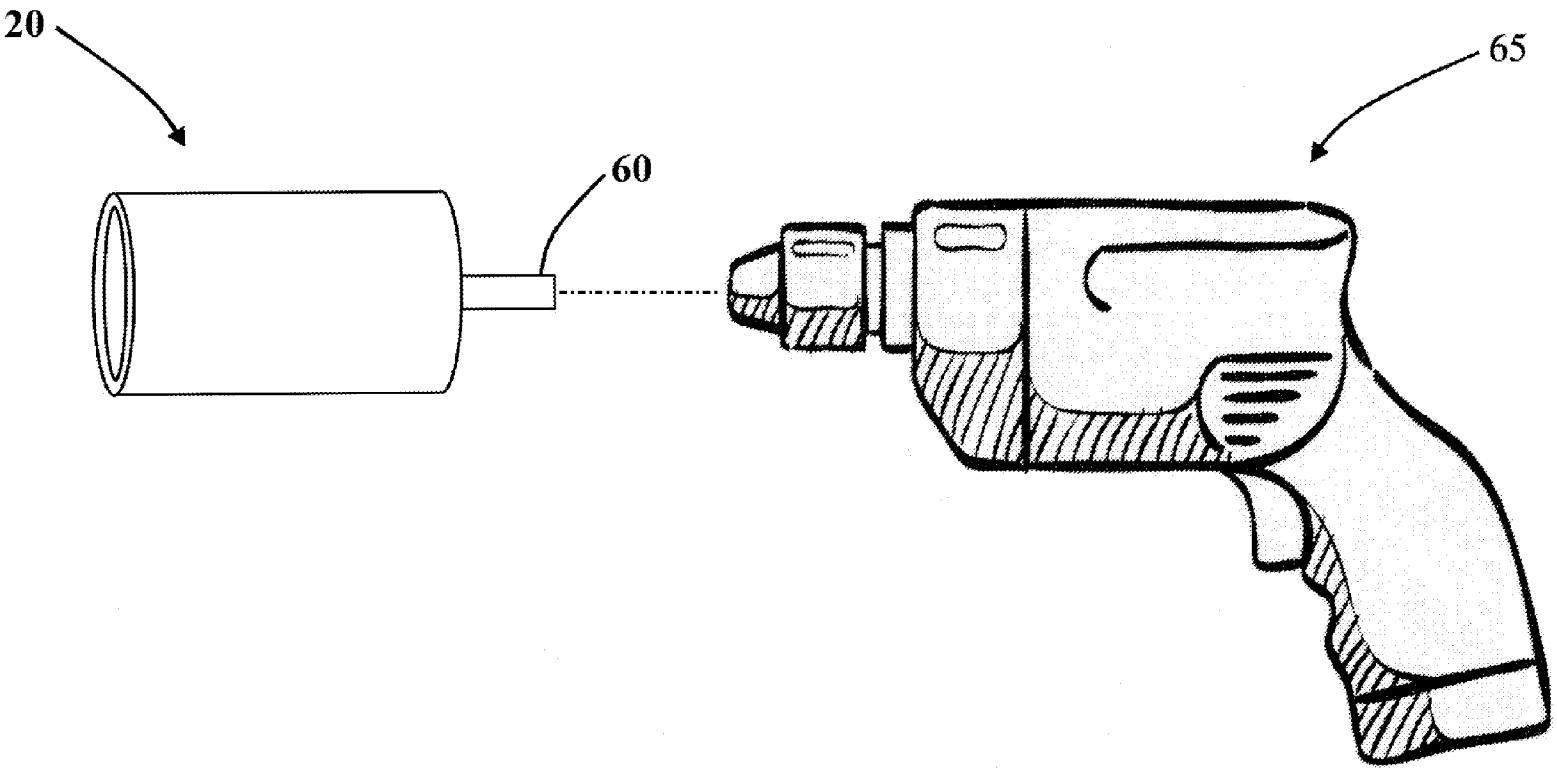
FIG. 6 is a perspective view of the brush sleeve of another embodiment of the present invention.
Figure 7:
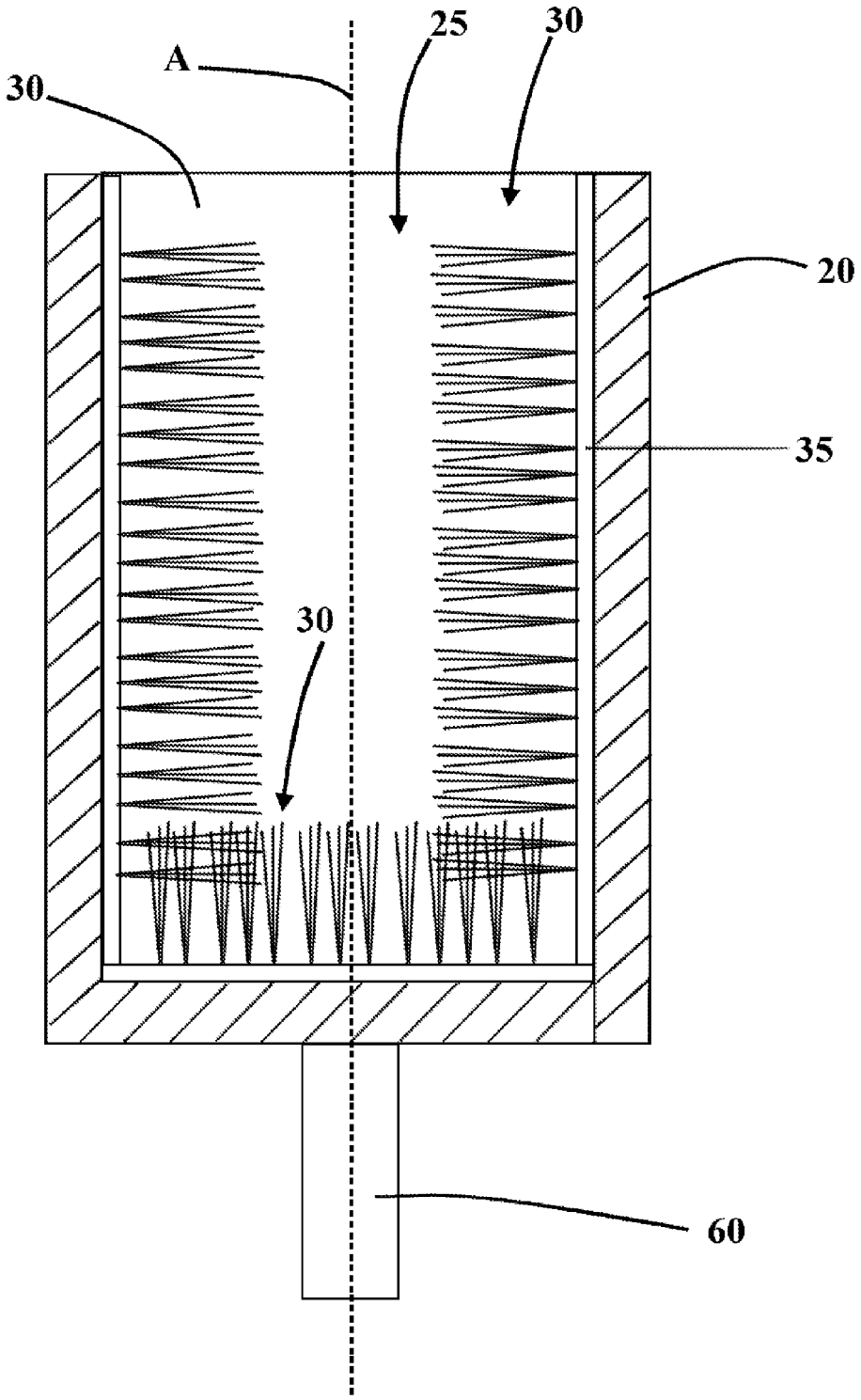
FIG. 7 is a sectional view of the brush sleeve illustrated in FIG. 6.

Referring now to FIGS. 6 and 7, yet another embodiment of the brush sleeve 20 is illustrated. For example, in this embodiment, the brush sleeve 20 includes an elongated attachment rod 60 extending externally, and in many cases, coaxially (e.g., along axis A), from the distal end 29 of the brush sleeve 20. As illustrated in FIG. 6, the elongated attachment rod 60 may be structured to fit into or attach to a driving source, such as a power tool, power screwdriver or power drill 65. The power tool may be cordless and operate via rechargeable batteries, allowing the invention to operate in cases where power outlets may not be readily available. In this manner, the power tool 65 may be used to grip the elongated attachment rod 60, similar to the way in which the power tool is configured to grip a drill bit or other attachment. Use of the power tool 65 will thus include rotationally driving the attached brush sleeve 20 in a rapid fashion.

Figure 8A:
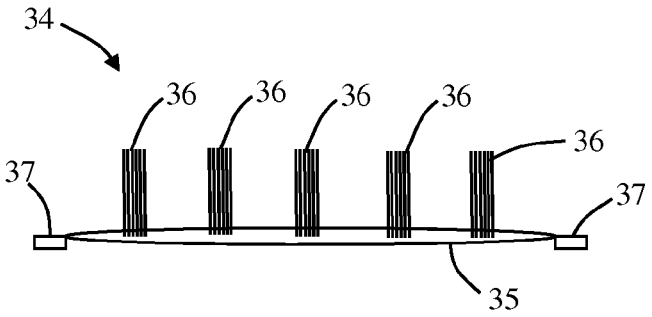
FIG. 8A is a side view of the distal brush component as disclosed in accordance with yet another embodiment herein.
Figure 8B:
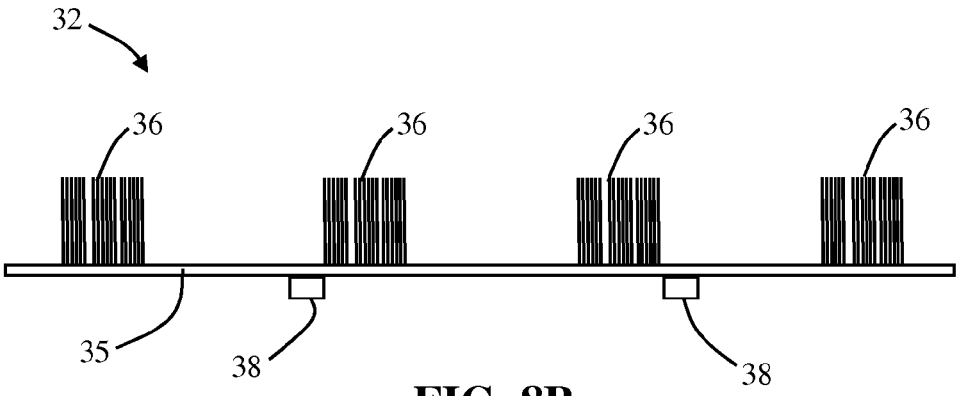
FIG. 8B is a side view of the side brush component as disclosed in accordance with yet another embodiment herein.
Figure 9A:
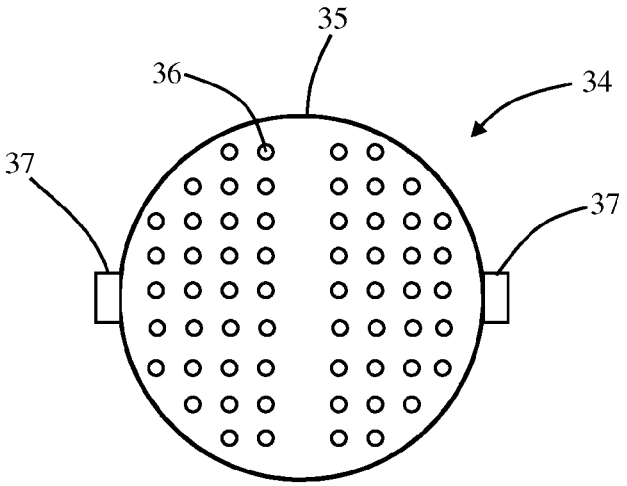
FIG. 9A is a top view of the distal brush component illustrated in FIG. 8A.
Figure 9B:
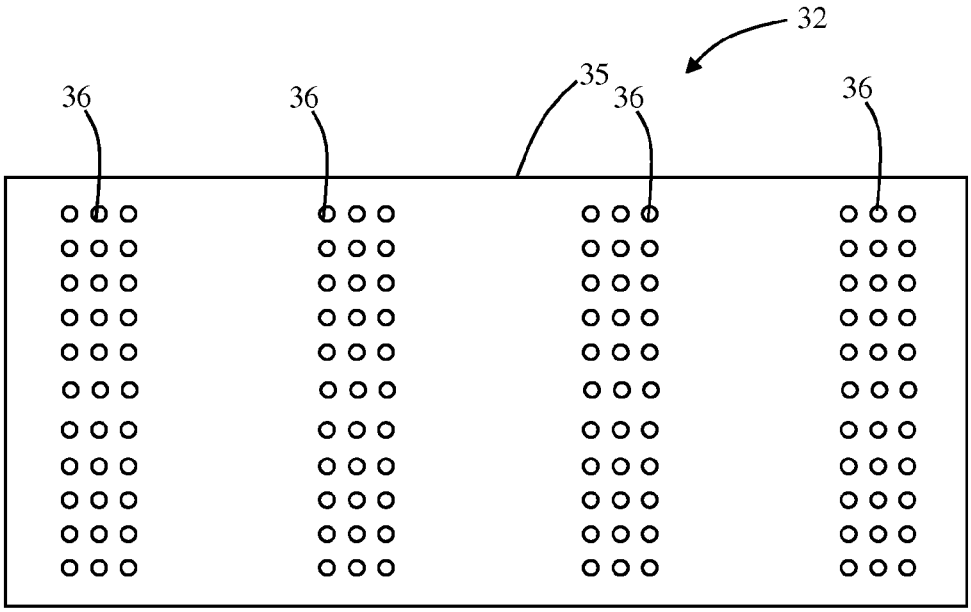
FIG. 9B is a top view of the side brush component illustrated in FIG. 8B.

FIGS. 8A, 8B, 9A and 9B illustrate yet another embodiment of the brush components 30 that can be cooperatively disposed within the brush sleeve 20. For example, FIG. 8A illustrates a side elevation view of the bottom or distal brush component 34 of one embodiment, and FIG. 8B illustrates a side elevation view of the side or lateral brush component 32. Similarly, FIG. 9A illustrates a top view of the bottom or distal brush component 34 and FIG. 9B illustrates a top view of the side or lateral brush component 32.

Particularly, the bottom or distal brush component 34 of the embodiment illustrated in FIGS. 8A and 9A includes a plurality of bristles 36 or other scrubbing components attached to a base 35. The base 35 may be constructed of a partially flexible material, including, but not limited to a soft or flexible plastic, rubber, or resin material. Disposed on a peripheral edge of the bottom or distal brush component 34 is at least one or more protrusions or positioning members 37 that extend at least partially outward therefrom. Referring to the modified brush sleeve 20 of FIG. 10, the protrusions or positioning members 37 of the bottom or distal brush 34 will cooperatively fit into the retention channels 26 cooperatively positioned on the inside wall of the brush sleeve 20, as shown. For instance, the retention channels 26 may extend from the open proximal end 21 of the brush sleeve 20 down to the inner surface of the distal end 29 of the brush sleeve 20. In this manner, the bottom or distal brush 34 may be slidingly disposed within the brush sleeve 20, for example, by aligning the protrusions or positioning member(s) 37 into the retention channels 26. In the embodiment illustrated in FIGS. 8A, 9A and 10, the bottom or distal brush component 34 may, but need not necessarily, include a substantially similar shape or configuration (e.g., rounded configuration) as the inside surface of the brush sleeve 20.

Referring now to FIGS. 8B and 9B, the lateral or side brush component 32 of at least one embodiment is illustrated. In this embodiment, a single lateral or side brush sleeve 32 may be constructed, such that separate lateral brush components need not be separately slidingly engaged within the brush sleeve 20.

Specifically, the side or lateral brush component 32 of the embodiment illustrated in FIGS. 8B and 9B includes a plurality of bristles 36 or other scrubbing components attached to a base 35. The base 35 may be constructed of a partially flexible material, including, but not limited to a soft or flexible plastic, rubber, or resin material. Extending outward from the base 35, for example, on a side opposite from the bristles 36, is at least one or more protrusions or positioning members 38.

Figure 10:
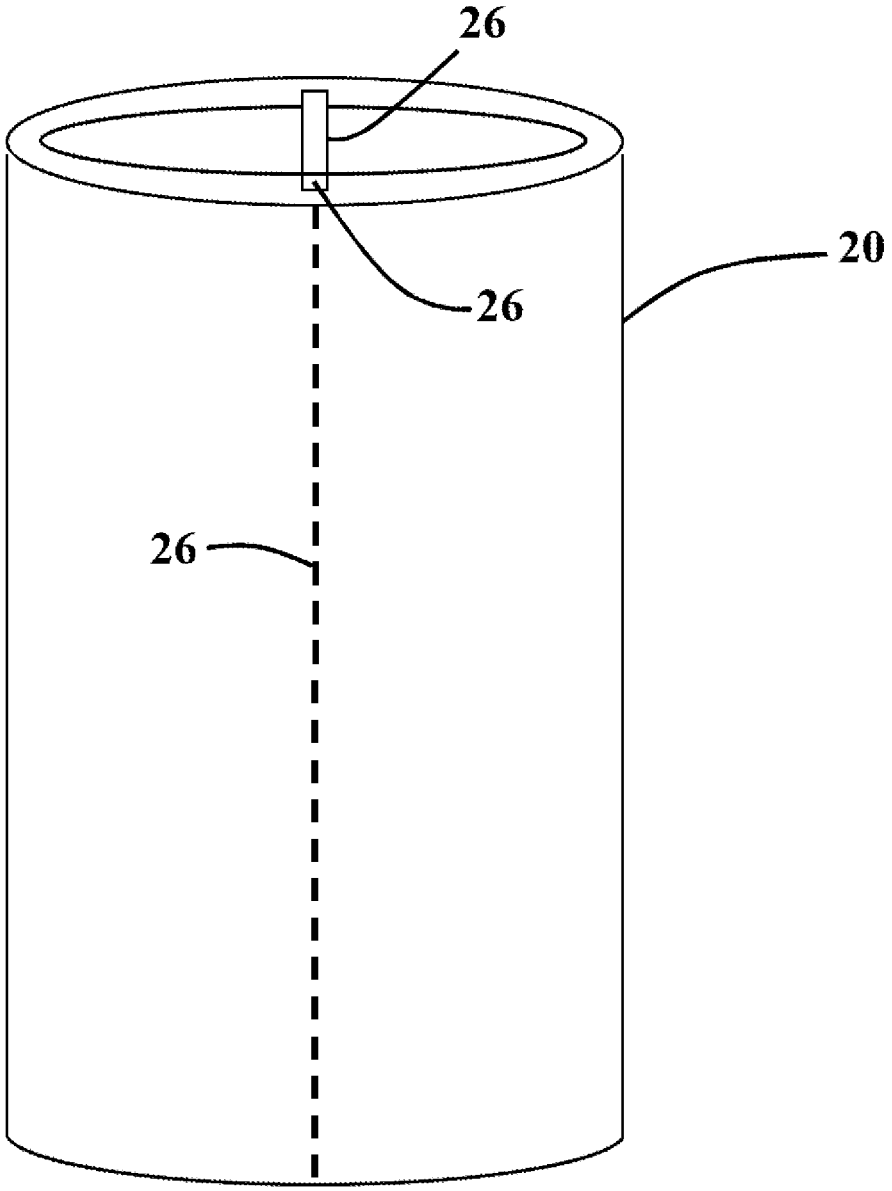
FIG. 10 is a partial perspective view of the brush sleeve and retention cap of yet another embodiment.

Referring again to the modified brush sleeve 20 of FIG. 10, the protrusions or positioning members 38 of the side or lateral brush 32 will also cooperatively fit into the retention channels 26 positioned on the inside wall of the brush sleeve 20, as shown. In this manner, the distance between the protrusions or positioning members 38 is equal to the distance between the retention channels 26. Accordingly, the brush component 32 of one embodiment may be flexibly rolled, curled or bent and inserted into the brush sleeve 20 with the positioning members 38 aligned with the retention channels 26.

Again, a retention cap 12 may be secured over the open end 21 of the brush sleeve 20, for example, to retain the brush components 32, 34 in place during operation of the present invention.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A finger scrubber, comprising:

a brush sleeve and a body, said brush sleeve comprising an at least partially open end and an oppositely disposed closed end defining an interior portion there between, at least one brush component disposed within said interior portion of said brush sleeve, said body comprising a sleeve housing and a drive assembly, said brush sleeve being coaxially and removably disposed within said sleeve housing, said drive assembly being structured engage said brush sleeve and at least temporarily drive said brush sleeve in a rotational manner within said sleeve housing, and an activation assembly engaged by said brush sleeve for selectively activating said drive assembly.

2. The finger scrubber as recited in claim 1 wherein said brush sleeve is disposed in alternating rotational directions within said sleeve housing via successive activations of said drive assembly.

3. The finger scrubber as recited in claim 1 wherein said activation assembly comprises a contact switch; said drive assembly being activated and said brush sleeve being rotationally driven within said brush housing while said contact switch is activated.

4. The finger scrubber as recited in claim 1 wherein said drive assembly comprises a rotational drive mechanism disposed within said brush housing; said brush sleeve comprising a drive engagement portion cooperatively configured to engage said rotational drive mechanism.

5. The finger scrubber as recited in claim 4 wherein said drive engagement portion comprises a recessed portion disposed on said closed end of said brush sleeve.

6. The finger scrubber as recited in claim 5 wherein said brush sleeve is rotationally driven within said sleeve housing via a cooperative engagement between said drive engagement portion of said brush sleeve and said rotational drive mechanism of said drive assembly.

7. The finger scrubber as recited in claim 6 wherein said drive assembly is structured to dispose said brush sleeve is alternating rotational directions within said sleeve housing via successive activations of said drive assembly.

8. The finger scrubber as recited in claim 1 wherein said at least one brush component is cooperatively and removably engaged to an interior wall of said brush sleeve.

9. The finger scrubber as recited in claim 8 wherein said brush sleeve comprises at least one retention channel disposed on said interior wall within said interior portion; said at least one brush component comprising a base at least partially disposed within said at least one retention channel.

10. The finger scrubber as recited in claim 9 wherein said at least one retention channel extends substantially along the length of said brush sleeve between said at least partially open end and said oppositely disposed closed end.

11. An electrically driven finger scrubber, comprising:

a cylindrical brush sleeve and a body, said cylindrical brush sleeve comprising an at least partially open proximal end and an oppositely disposed distal end defining an interior portion there between, at least one brush component disposed within said interior portion of said brush sleeve, said body comprising a cylindrical sleeve housing and a drive assembly, said cylindrical brush sleeve being coaxially disposed within said cylindrical sleeve housing, an activation assembly selectively engaged by said cylindrical brush sleeve for activating said drive assembly, said drive assembly being structured to engage said cylindrical brush sleeve and at least temporarily drive said cylindrical brush sleeve in a rotational manner about a longitudinal axis, and wherein said drive assembly is structured to drive said brush sleeve in alternating rotational directions with each successive selective engagement of said activation assembly.

12. The finger scrubber as recited in claim 11 wherein said activation assembly is activated via pressure exerted on said activation assembly from said cylindrical brush sleeve.

13. The finger scrubber as recited in claim 12 wherein said activation assembly comprises a plunger disposed within said cylindrical sleeve housing and selectively engaged between said cylindrical brush sleeve and a contact switch.

14. The finger scrubber as recited in claim 11 wherein said at least one brush component is cooperatively and removably engaged to an interior wall of said cylindrical brush sleeve.

15. The finger scrubber as recited in claim 14 wherein said cylindrical brush sleeve comprises at least one retention channel disposed on said interior wall within said interior portion; said at least one brush component comprising a base at least partially disposed within said at least one retention channel.

* * * * *